United States Patent [19]

Lawrence

[11] Patent Number: 5,066,079

[45] Date of Patent: Nov. 19, 1991

[54] DOOR SAFE APPARATUS

[76] Inventor: James L. Lawrence, Rt. 6, Box 158M, Petersburg, Va. 23803

[21] Appl. No.: 529,563

[22] Filed: May 29, 1990

[51] Int. Cl.[5] ..... A47B 17/04

[52] U.S. Cl. ..... 312/204; 49/70; 109/54; 312/311

[58] Field of Search ..... 49/70; 109/50, 54; 312/311, 350, 323, 204

[56] References Cited

U.S. PATENT DOCUMENTS

| | | | |
|---|---|---|---|
| 1,510,103 | 9/1924 | Perkins | 312/350 X |
| 2,086,018 | 7/1937 | Dyer | 109/50 |
| 2,798,445 | 7/1957 | Gehman | 189/50 |
| 2,853,355 | 9/1958 | Paca et al. | 312/311 |
| 3,019,206 | 2/1963 | Glezen | 312/323 X |
| 3,160,448 | 12/1964 | Abernathy et al. | 312/323 X |
| 3,717,112 | 2/1973 | Welty | 109/54 X |
| 4,314,733 | 2/1982 | Smith | 312/311 X |

*Primary Examiner*—Joseph Falk
*Attorney, Agent, or Firm*—Leon Gilden

[57] ABSTRACT

Apparatus in combination with a door is provided wherein a cavity within a door includes a panel mounted retractably within the door to expose a cavity within the door. The cavity includes a slidably mounted cabinet wherein the cabinet includes a plurality of compartments each compartment including a latch member to secure each compartment within the cabinet for storage of valuables therewithin.

1 Claim, 4 Drawing Sheets

PRIOR ART

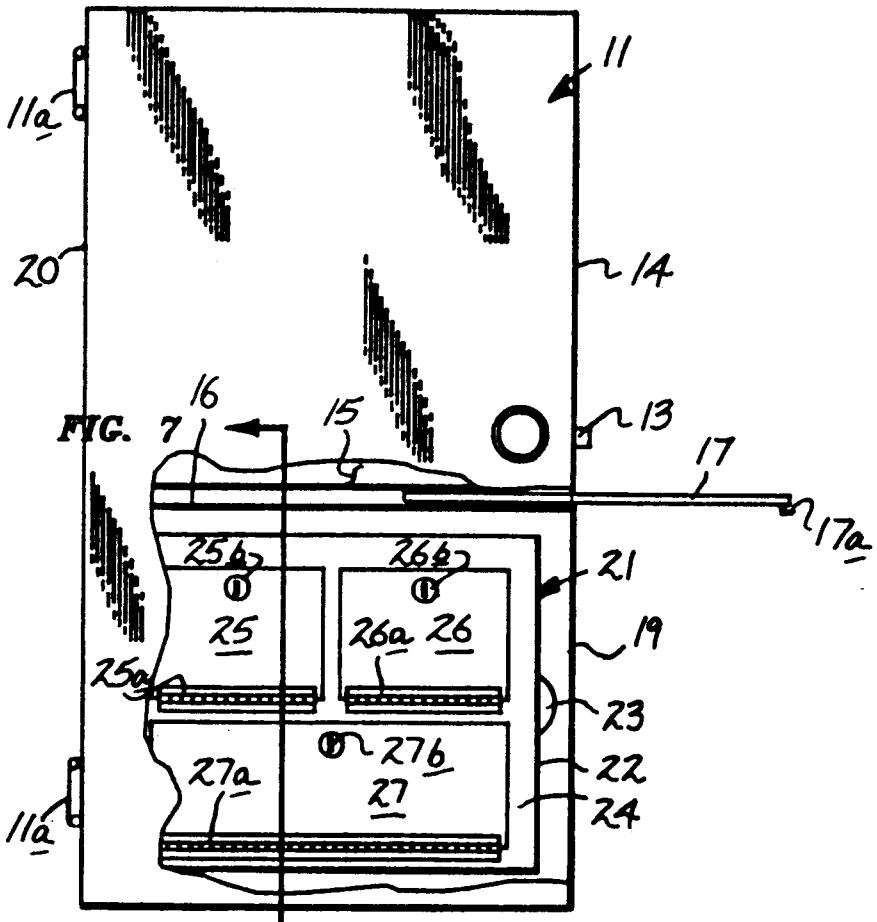
FIG. 4
FIG. 7
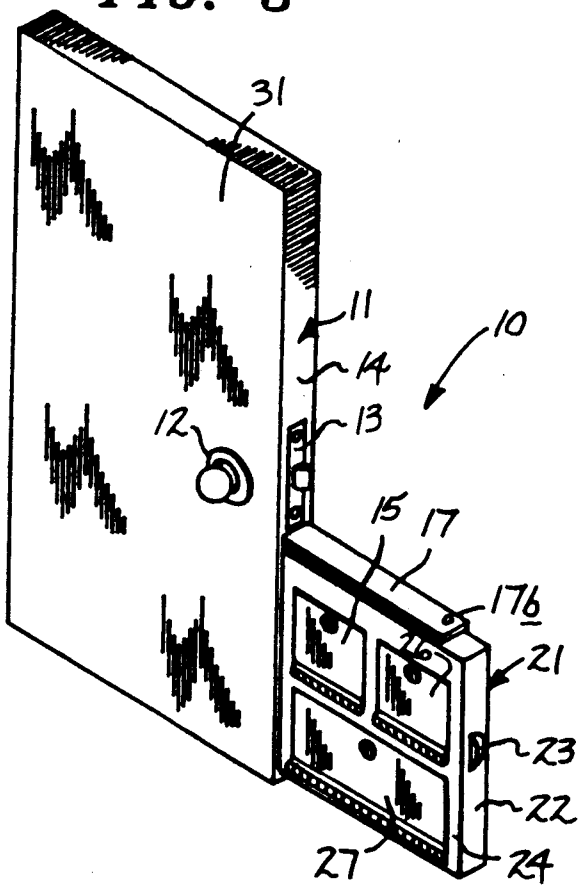
FIG. 3

DOOR SAFE APPARATUS

BACKGROUND OF THE INVENTION

1. Field of the Invention

The field of the invention relates to security storage devices, and more particularly pertains to a new and improved door safe apparatus wherein the same encloses in a secure and concealed manner a container for storage of valuables therewithin.

2. Description of the Prior Art

Safety storage containers and such organizations have been presented in the prior art tho heretofore been of relatively limited application due to expense and installation required for use by individuals. The instant invention attempts to overcome deficiencies of the prior art by providing organization of economical and compact construction permitting retrofitt into existing or newly constructed door members. Examples of the prior art apparatus include U.S. Pat. No. 3,717,112 to WELTY sets forth a safe member securable through a hinge plate of a door organization but is of a limited volumetric capacity limiting storage of valuables therewithin as opposed to the instant invention encompassing the door cavity of an associated door.

U.S. Pat. No. 4,172,424 to DE PALAU sets forth a wall safe for mounting within a wall structure in a conventional manner.

U.S. Pat. No. 4,244,303 to KURASIK sets forth a picture frame organization employing a compartment for storage of valuables therewithin.

U.S. Pat. No. 3,999,493 to GULYA sets forth a safety container mounted rearwardly of an electrical wall plate.

U.S. Pat. No. 4,083,314 to GARVIN sets forth a further storage unit mounted within a receptacle box rearwardly of an electrical wall plate to permit concealment of the storage unit.

As such, it may be appreciated that there continues to be a need for a new and improved door safe apparatus as set forth by the instant invention which addresses both the problems of ease of use as well as effectiveness in construction in concealing a storage container within a door cavity of an associated door.

SUMMARY OF THE INVENTION

In view of the foregoing disadvantages inherent in the known types of storage container apparatus present in the prior art, the present invention provides a new and improved door safe apparatus wherein the same permits concealment of a storage repository within an associated cavity of a door for selective storage of various valuables therewithin. As such, the general purpose of the present invention, which will be described subsequently in greater detail, is to provide a new and improved door safe apparatus which has all the advantages of the prior art safety repository units and none of the disadvantages.

To attain this, the door safe apparatus of the invention includes apparatus in combination with a door is provided wherein a cavity within a door includes a panel mounted retractably within the door to expose a cavity within the door. The cavity includes a slidably mounted cabinet wherein the cabinet includes a plurality of compartments each compartment including a latch member to secure each compartment within the cabinet for storage of valuables therewithin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door safe apparatus which has all the advantages of the prior art storage units and none of the disadvantages.

It is another object of the present invention to provide a new and improved door safe apparatus which may be easily and efficiently manufactured and marketed.

It is a further object of the present invention to provide a new and improved door safe apparatus which is of a durable and reliable construction.

An even further object of the present invention is to provide a new and improved door safe apparatus which is susceptible of a low cost of manufacture with regard to both materials and labor, and which accordingly is then susceptible of low prices of sale to the consuming public, thereby making such door safe apparatuses economically available to the buying public.

Still yet another object of the present invention is to provide a new and improved door safe apparatus which provides in the apparatuses and methods of the prior art some of the advantages thereof, while simultaneously overcoming some of the disadvantages normally associated therewith.

Still another object of the present invention is to provide a new and improved door safe apparatus which may be compactly stored when not being utilized.

Yet another object of the present invention is to provide a new and improved door safe apparatus wherein the same permits convenient and effective concealed storage of various valuables within a cavity contained wholly within an associated door structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an orthographic frontal view of the instant invention partially in section.

DESCRIPTION OF THE PREFERRED EMBODIMENT

Figure 1:
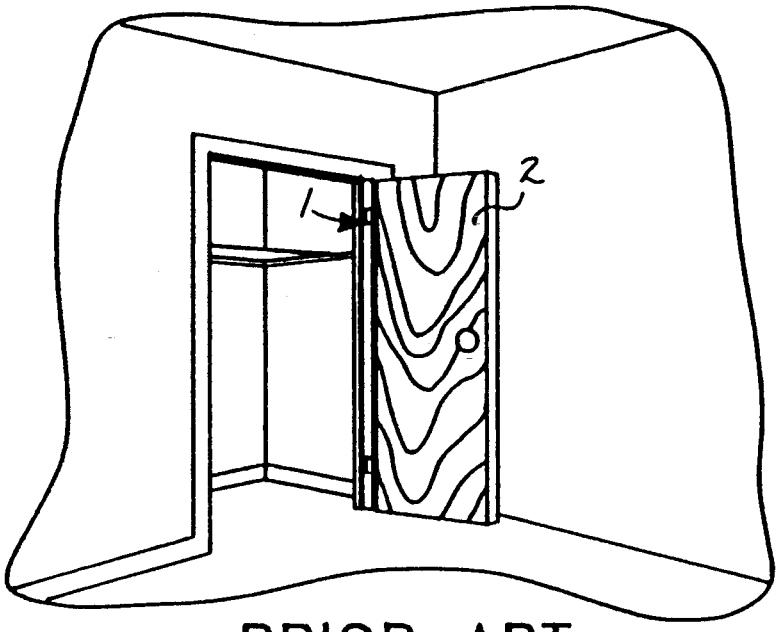
FIG. 1 is an isometric illustration of a prior art door storage apparatus.
Figure 2:
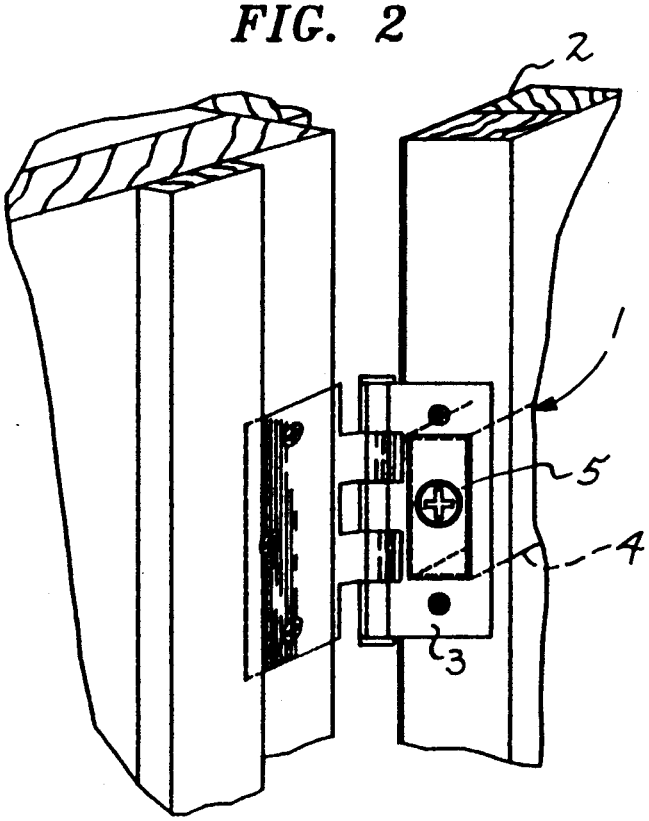
PRIOR ART FIG. 2
FIG. 2 is an isometric illustration of the prior art structure as set forth in FIG. 1 enlarged for illustration of the various components and their relationship.
Figure 6:
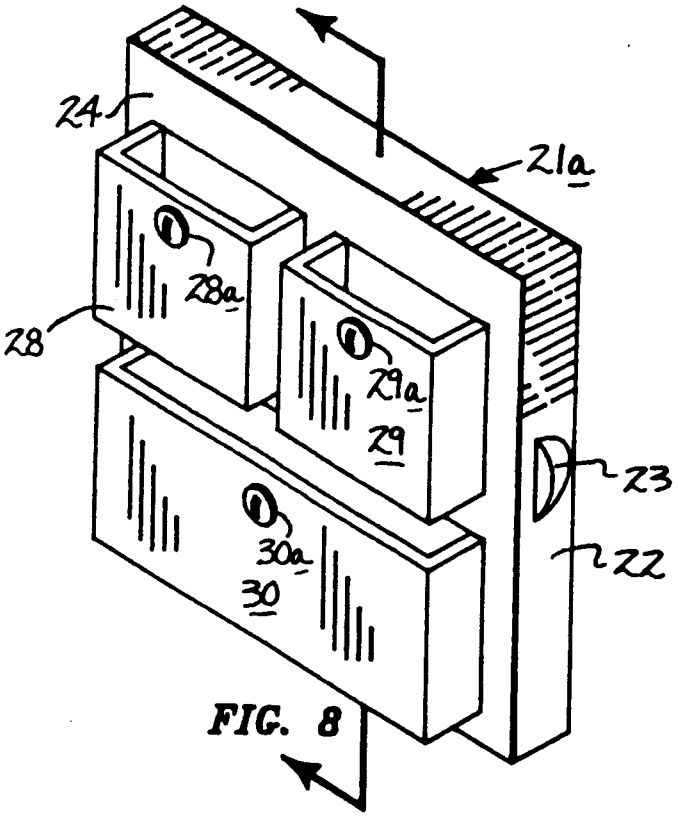
FIG. 6 is an isometric illustration of a modified storage container utilized by the instant invention.
Figure 5:
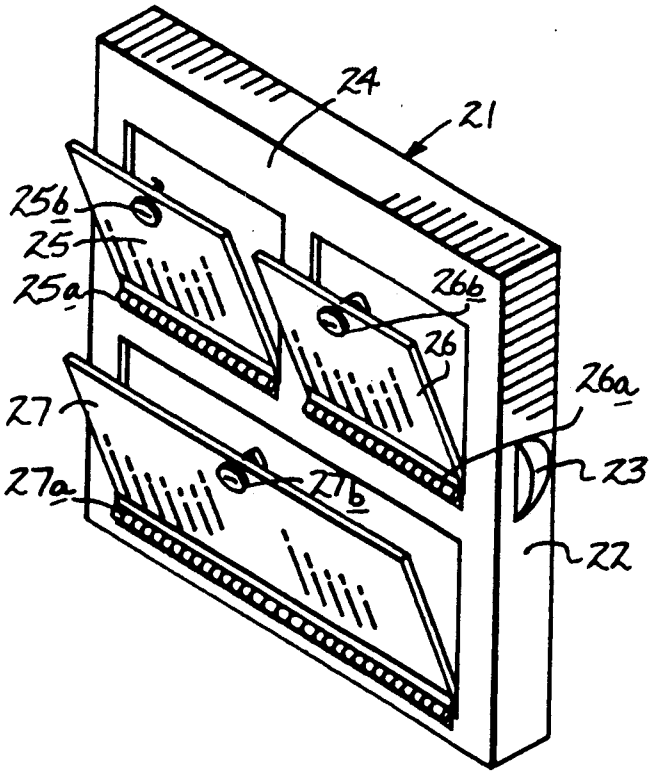
FIG. 5 is an isometric illustration of the storage container utilized by the instant invention.

With reference now to the drawings, and in particular to FIGS. 1 to 8 thereof, a new and improved door safe apparatus embodying the principles and concepts of the present invention and generally designated by the reference numeral 10 will be described.

FIG. 1 illustrates a prior art storage unit 1 within a door 2 wherein the unit includes a housing 4 directed through a hinge plate 3 of an associated door utilizing an access member 5 to gain access to the container 4 of the prior art.

More specifically, the door safe apparatus 10 of the instant invention essentially comprises a door member 11 including a plurality of spaced door hinges 11*a* mounted to a rear end wall 20 of the door member 11. The door member 11 further includes a forward end wall 14 spaced from and parallel the rear end wall with the forward end wall 14 including a door latch 13 mounted therewithin.

Further, the door member 11 includes a door handle 12 directed through the forward door wall 31 adjacent the forward end wall 14. A door cavity 15 is wholly contained within the door member 11 between the rear end wall 20 and the forward end wall 14 below the door latch 13. The door cavity 15 includes a cover flap 17 removably mounted relative to the door cavity 15 defining a slot 19 directed through the forward end wall 14 to provide access to the door cavity 15. The cover flap 17 includes a securement clasp 17*a* defined by a screw head 17*b* permitting rotation of securement clasp 17*a* to secure the cover flap 17 to overly the slot 19 and the rearwardly oriented door cavity 15. The cover flap 17 is slidably received within a plurality of confronting U-shaped guides 16 mounted to interior surfaces of the forward door wall 31 and the rear door wall 32 (see FIGS. 7 and 8) wherein each of the U-shaped guides 16 are arranged generally parallel to a door cavity floor panel 18 defining a bottom wall of the door cavity 15.

A security container 21 is retractively received within the door cavity 15 as illustrated in FIG. 3 for example.

Figure 7:
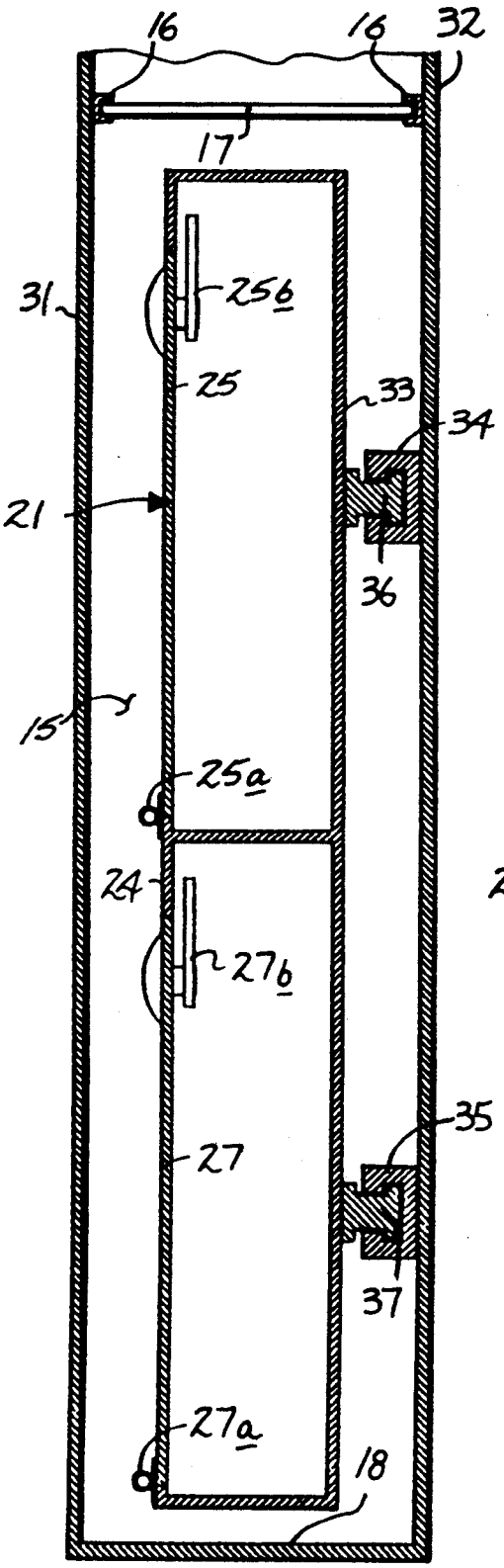
FIG. 7 is an orthographic view taken along the lines 7—7 of FIG. 4 in the direction indicated by the arrows.
Figure 8:
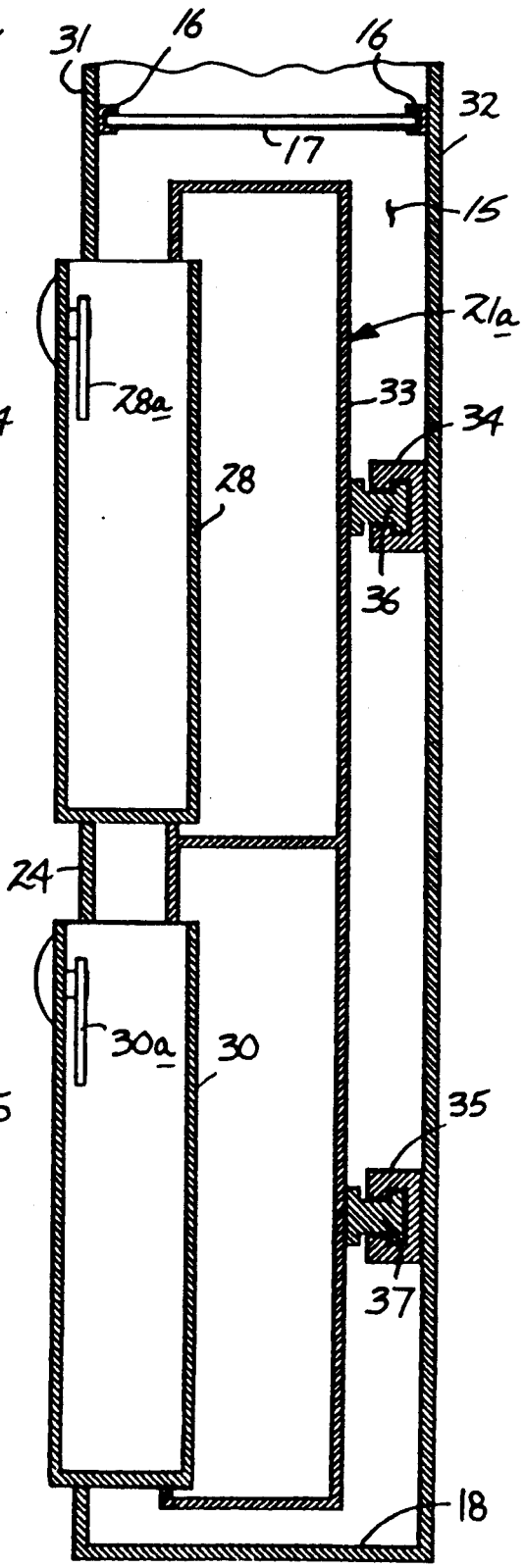
FIG. 8 is an orthographic view taken along the lines 8—8 of FIG. 6 in the direction indicated by the arrows.

The container 21 defines a generally parallelepiped configuration and includes a container forward end wall 22 arranged with a handle 23 fixedly mounted thereon to permit retraction of the container 21 from the cavity 15. The container further includes a container forward wall 24 with a first, second, and third door panel 25, 26, and 27 respectively mounted to container forward wall 24. Each respective door panel includes a respective first, second, and third hinge 25*a*, 26*a*, and 27*a* fixedly mounted to a lower terminal edge of each door panel and the forward wall 24 to permit pivotment of each door panel relative thereto to gain access to a compartment defined rearwardly of each door panel. Further, each respective door panel includes a first, second, and third latch member 25*b*, 26*b*, and 27*b* respectively directed through each respective first, second, and third door panel (see FIG. 7 for example) to permit securement and locking of each door panel relative to the container forward wall 24. In reference to FIG. 7 to FIG. 8 illustrates the use of an upper track 34 spaced parallel to and overlying lower track 35 which are each parallel to the door cavity floor panel 18 and arranged generally orthogonally to the forward end wall 14.

Each upper and lower track are defined by a T-shaped slot coextensive with each track. The rear cavity wall 33 includes an upper T-shaped projection 36 and a lower T-shaped projection 37 wherein the T-shaped projections 36 and 37 are arranged parallel relative to one another and are spaced apart a predetermined spacing equal to a predetermined spacing spaced between the upper and lower tracks 34 and 35. Further, each T-shaped projection is complementarily received in a sliding manner within each of the T-shaped upper and lower tracks 34 and 35 respectively to permit sliding securement of the cabinet 21 and the modified cabinet 21*a* within each door cavity 15 and further to minimize a rattling of each cabinet to permit inconspicuous positioning of each cabinet within each door cavity 15.

The modified cabinet 21*a* includes in leu of the first, second, and third door panels 25, 26, and 27, a respective first, second, and third slide out drawer 28, 29, and 30. Each slide out drawer includes a respective first, second, and third drawer latch plate 28*a*, 29*a*, and 30*a* each also configured for rotation to secure each drawer within the container forward wall 24.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patents of the United States is as follows:

1. A door safe apparatus comprising in combination, a door, the door including a forward door wall spaced from and parallel a rear door wall, and the door including a rear end wall spaced from and parallel to a forward end wall, the forward end wall including a latch member mounted therewithin, and a door cavity formed within the door positioned below the latch member, the door cavity including a slot directed through the forward end wall, and a cover flap removably mounted in alignment with the forward wall covering the slot in a first position and displaceable to a second position orthogonally oriented relative to the forward wall removed from the slot, and a security container mounted within the cavity selectively removable therefrom through the slot, and wherein the cover flap includes a securement clasp to secure the cover flap in alignment with the forward end wall, and wherein the door cavity includes a first and second "U" shaped guide, the first and second "U" shaped guide mounted within the door cavity above the container, and each of the "U" shaped guides arranged in confronting relationship to slidably receive the cover flap therewithin to secure the cover flap in the second position displaced relative to the slot, and wherein the container includes a container forward wall and a plurality of door members mounted in the container forward wall, each door member including a latch to secure each door member to the container, and wherein the container includes a container rear wall spaced from the forward wall, an upper and lower "T" shaped projection, the "T" shaped projections mounted to the container rear wall spaced apart a predetermined spacing, and the rear door wall including an upper and lower track, the upper and lower track are arranged parallel relative to one another and spaced apart the predetermined spacing to respectively receive in a slidable relationship the upper and lower "T" shaped projections within each upper and lower track respectively, and wherein each upper and lower track includes a "T" shaped slot, each "T" shaped slot of a complementary configuration to each "T" shaped projection, and wherein each door member includes a hinge, each hinge pivotally mounting each door member to the container, and each container further includes a latch member to selectively secure each door member to the container, and wherein the container includes a container forward end wall wherein the container forward end wall includes a handle mounted thereon to permit selective removal of the container relative to the door cavity, and wherein the door cavity includes a door cavity floor, the door cavity floor arranged parallel to the upper and lower tracks wherein the container is spaced above the floor.

* * * * *